US010631601B2

(12) United States Patent
Pashandi

(10) Patent No.: US 10,631,601 B2
(45) Date of Patent: Apr. 28, 2020

(54) DELTA-SHAPED UMBRELLA HAVING A SPRING-LOADED HUB

(71) Applicant: Jalal Pashandi, Los Angeles, CA (US)

(72) Inventor: Jalal Pashandi, Los Angeles, CA (US)

( * ) Notice: Subject to any disclaimer, the term of this patent is extended or adjusted under 35 U.S.C. 154(b) by 0 days.

(21) Appl. No.: 16/430,355

(22) Filed: Jun. 3, 2019

(65) Prior Publication Data

US 2020/0000188 A1 Jan. 2, 2020

Related U.S. Application Data

(60) Provisional application No. 62/692,749, filed on Jun. 30, 2018.

(51) Int. Cl.

| | |
|---|---|
| ***A45B 11/00*** | (2006.01) |
| ***A45B 23/00*** | (2006.01) |
| *A45B 25/02* | (2006.01) |

(52) U.S. Cl.

CPC ..... *A45B 11/00* (2013.01); *A45B 23/00* (2013.01); *A45B 25/02* (2013.01); *A45B 2011/005* (2013.01); *A45B 2023/0012* (2013.01)

(58) Field of Classification Search

CPC ..... A45B 23/00; A45B 2023/0093; A45B 2023/0012; A45B 25/16; A45B 11/00; A45B 2011/005; A45B 2019/007; E04H 15/003; E04H 15/58; E04H 15/48; E04H 15/34

See application file for complete search history.

(56) References Cited

U.S. PATENT DOCUMENTS

| | | | | | |
|---|---|---|---|---|---|
| 1,547,538 | A * | 7/1925 | Vincent | A45B 25/10 | 135/15.1 |
| 2,888,021 | A * | 5/1959 | Adams | A45B 23/00 | 135/154 |
| 3,069,021 | A * | 12/1962 | Gray | D06F 57/04 | 211/197 |
| 6,095,230 | A * | 8/2000 | Mitchell | B60J 1/2091 | 160/370.21 |
| 6,116,256 | A * | 9/2000 | Pawsey | A45B 19/00 | 135/120.3 |
| 6,904,923 | B2 * | 6/2005 | Chai | B60J 1/2011 | 135/21 |
| 9,874,038 | B2 | 1/2018 | Pashandi | | |
| 10,184,265 | B2 | 1/2019 | Pashandi | | |
| 2007/0034342 | A1 * | 2/2007 | Fill | A45B 11/00 | 160/351 |
| 2017/0202321 | A1 * | 7/2017 | Maurello | A45B 23/00 | |

* cited by examiner

*Primary Examiner* — Noah Chandler Hawk
(74) *Attorney, Agent, or Firm* — Edwin Tarver

(57) ABSTRACT

A delta-shaped umbrella apparatus for shading or shielding a user from the rain includes a hub configured for receiving a handle. The hub has a plurality of spring receptacles, and a plurality of springs, with each spring having a coiled portion, a lower anchoring portion, and an upper anchoring portion. Each spring receptacle has a spring chamber configured to hold the coiled portion, at least one anchoring hole configured for the lower anchoring portion to be inserted therethrough, and a slot. A plurality of ribs are anchored to the plurality of springs' upper anchoring portions, and each slot is configured to allow the a rib to swing through a predetermined range of motion relative to the hub. The range of motion defines an arc extending from a position substantially parallel to the handle to a position substantially perpendicular to the handle.

20 Claims, 4 Drawing Sheets

DELTA-SHAPED UMBRELLA HAVING A SPRING-LOADED HUB

BACKGROUND

Field of the Invention

The present invention generally relates to umbrellas. More specifically, the present invention relates to a delta-shaped umbrella having a spring loaded hub.

Related Art

Umbrellas are known in the art, and conventionally include a canopy stretched over a radially symmetrical plurality of ribs, with the ribs extending from a central handle. Umbrellas of this type have been used over the years to protect users from rain, and to provide a parasol-type sun-shading apparatus where necessary. There are several drawbacks to the conventional umbrella design, however, in that the handle is placed in the middle of the shading surface. Such an arrangement wastes much of the shading/protecting space of the canopy, requires users to hold the handle inconveniently close to their person, and causes a large portion of the canopy to cover wasted space.

In response to these drawbacks, Applicant created a collapsible sun shade, currently designated U.S. Pat. Nos. 9,874,038 and 10,184,265. These utility models avoid the problems inherent in conventional umbrellas, by locating the handle of the umbrella off to one side. Specifically, they provide a somewhat delta-shaped canopy, with a hub and the handle located at one extreme end of the delta shape. While Applicant presents one solution to the problems inherent in the art with the patented cases, there remained room in the art for an improved hub design for a delta-shaped umbrella.

Hence, what is needed is a delta-shaped umbrella, that provides an improved hub and unfolding mechanism without the limitations of existing techniques.

SUMMARY

A delta-shaped umbrella apparatus is configured for sun-shading or shielding a user from the rain. In a first preferred embodiment, the apparatus includes a hub configured for receiving a handle. The hub is also configured to have a first spring receptacle, a second spring receptacle, and a third spring receptacle. A first spring is provided, with a first coiled portion, a first lower anchoring portion and a first upper anchoring portion. Additionally, a second spring is provided with a second coiled portion, a second lower anchoring portion, and a second upper anchoring portion and a third spring has a third coiled portion, a third lower anchoring portion, and a third upper anchoring portion.

The first spring receptacle has a first spring chamber that holds the first coiled portion. The first spring chamber includes a first anchoring hole configured for the first lower anchoring portion to be inserted therethrough, and a first slot. Likewise, the second spring receptacle has a second spring chamber configured to hold the second coiled portion, a second anchoring hole configured for the second lower anchoring portion to be inserted therethrough, and a second slot, and the third spring receptacle has a third spring chamber configured to hold the third coiled portion, a third anchoring hole configured for the third lower anchoring portion to be inserted therethrough, and a third slot.

A first rib is anchored to the first upper anchoring portion of the first spring. A second rib is anchored to the second upper anchoring portion of the second spring, and a third rib is anchored to the third upper anchoring portion of the third spring. The first slot is configured to allow the first rib to swing through a first predetermined range of motion relative to the hub. Likewise, the second slot is configured to allow the second rib to swing through a second predetermined range of motion, and the third slot is configured to allow the third rib to swing through a third predetermined range of motion. Preferably, the first predetermined range of motion and the second predetermined range of motion define substantially similar arcs.

In this embodiment, a cap covers the hub, with the cap confining the first coiled portion in the first spring chamber, confining the second coiled portion in the second spring chamber, and also confining the third coiled portion in the third spring chamber. The first spring chamber preferably comprises multiple first anchoring holes. Also, the second spring chamber preferably comprises multiple second anchoring holes, and the third spring chamber preferably comprises multiple third anchoring holes.

Also in this embodiment, the first predetermined range of motion and the second predetermined range of motion each preferably extend from a position where the first rib and the second rib are substantially parallel to the handle, to a position where the first rib and the second rib are substantially perpendicular to the handle. The third predetermined range of motion is preferably greater than the first range of motion and second range of motion, such that the third rib is higher than the first rib and the second rib when extended away from the handle.

The apparatus preferably also includes a canopy extending between the first rib and the second rib. The canopy preferably comprises a first tube for receiving the first rib, a second tube for receiving the second rib, and a third tube for receiving the third rib. The canopy also may include a first fringe portion hanging from the first tube and a second fringe portion hanging from the second tube.

In a first alternative embodiment apparatus, the delta-shaped umbrella apparatus for sun-shading or shielding a user from the rain includes a hub configured for receiving a handle, with the hub further configured to have a first spring receptacle and a second spring receptacle. A first spring is provided, having a first coiled portion, a first lower anchoring portion, and a first upper anchoring portion, and a second spring is provided, having a second coiled portion, a second lower anchoring portion, and a second upper anchoring portion.

The first spring receptacle preferably includes a first spring chamber configured to hold the first coiled portion, a first anchoring hole configured for the first lower anchoring portion to be inserted therethrough, and a first slot. The second spring receptacle preferably includes a second spring chamber configured to hold the second coiled portion, a second anchoring hole configured for the second lower anchoring portion to be inserted therethrough, and a second slot.

A first rib is anchored to the first upper anchoring portion of the first spring, and a second rib is anchored to the second upper anchoring portion of the second spring. The first slot is configured to allow the first rib to swing through a first predetermined range of motion relative to the hub, and the second slot is configured to allow the second rib to swing through a second predetermined range of motion. Preferably, the first predetermined range of motion and the second predetermined range of motion define substantially similar arcs.

In this embodiment, the apparatus also includes a cap covering the hub, with the cap confining the first coiled portion in the first spring chamber, and confining the second coiled portion in the second spring chamber. The first spring chamber preferably includes multiple first anchoring holes, and the second spring chamber preferably includes multiple second anchoring holes. Preferably, the first predetermined range of motion and the second predetermined range of motion each extend from a position where the first rib and the second rib are substantially parallel to the handle, to a position where the first rib and the second rib are substantially perpendicular to the handle.

Preferably, the apparatus also includes a canopy extending between the first rib and the second rib. The canopy may include a first tube for receiving the first rib, and a second tube for receiving the second rib. Additionally, the canopy may include a first fringe portion hanging from the first tube and a second fringe portion hanging from the second tube.

In a third alternative the delta-shaped umbrella apparatus for sun-shading or shielding a user from the rain includes a hub configured for receiving a handle. The hub is further configured to have a plurality of spring receptacles. A plurality of springs is also provided, with each spring having a coiled portion, a lower anchoring portion, and an upper anchoring portion. Each spring receptacle includes a spring chamber configured to hold the coiled portion, at least one anchoring hole configured for the lower anchoring portion to be inserted therethrough, and a slot.

A plurality of ribs are anchored to the upper anchoring portion of the plurality of springs, and the slot is preferably configured to allow the at least one rib to swing through a predetermined range of motion relative to the hub. The predetermined range of motion defines an arc extending from a position substantially parallel to the handle to a position substantially perpendicular to the handle. Preferably this embodiment apparatus also includes a canopy, which is supported by the plurality of ribs.

DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not limited to the embodiments shown, but is to be accorded the widest scope consistent with the principles and features disclosed herein.

Figure 1:
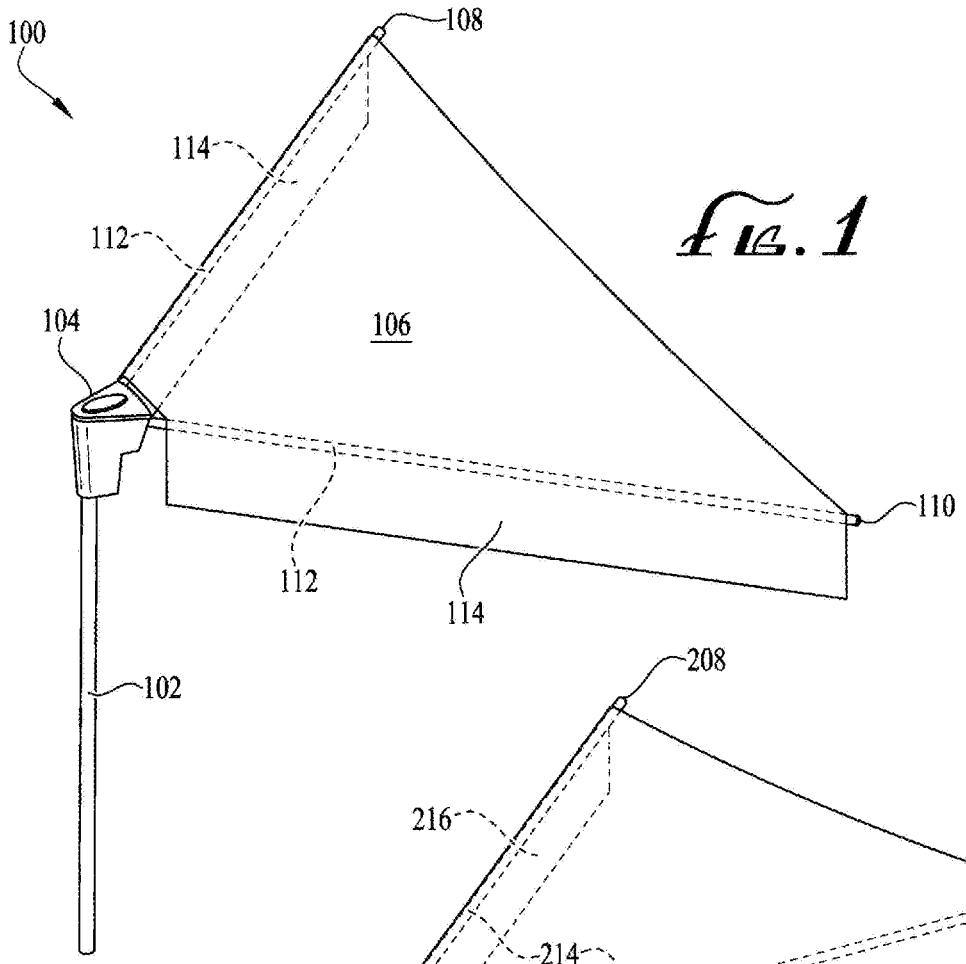
FIG. 1 illustrates a perspective view of a delta-shaped umbrella having a spring-loaded hub, with a canopy having two ribs.

Referring to FIG. 1, a first embodiment delta-shaped umbrella 100 is shown, having a handle 102, a spring-loaded first embodiment hub 104, and a first embodiment canopy 106. The canopy 106 is delta-shaped, and the handle 102 and the hub 104 are offset to one corner of the canopy 106 for maximum coverage. Supporting the canopy 106 are a first rib 108 and a second rib 110 extending away from the hub 104. The first rib 108 and the second rib 110 are biased to an upright position, perpendicular to the handle 102, but may be folded downward to rest adjacent the handle 102 for storage when not in use. In the illustrated embodiment, the canopy 106 includes two tubes 112 through which the first rib 108 and the second rib 110 extend, and two fringe portions 114 that hang down from under the first rib 108 and the second rib 110 to provide enhanced shading to the user.

Figure 2:
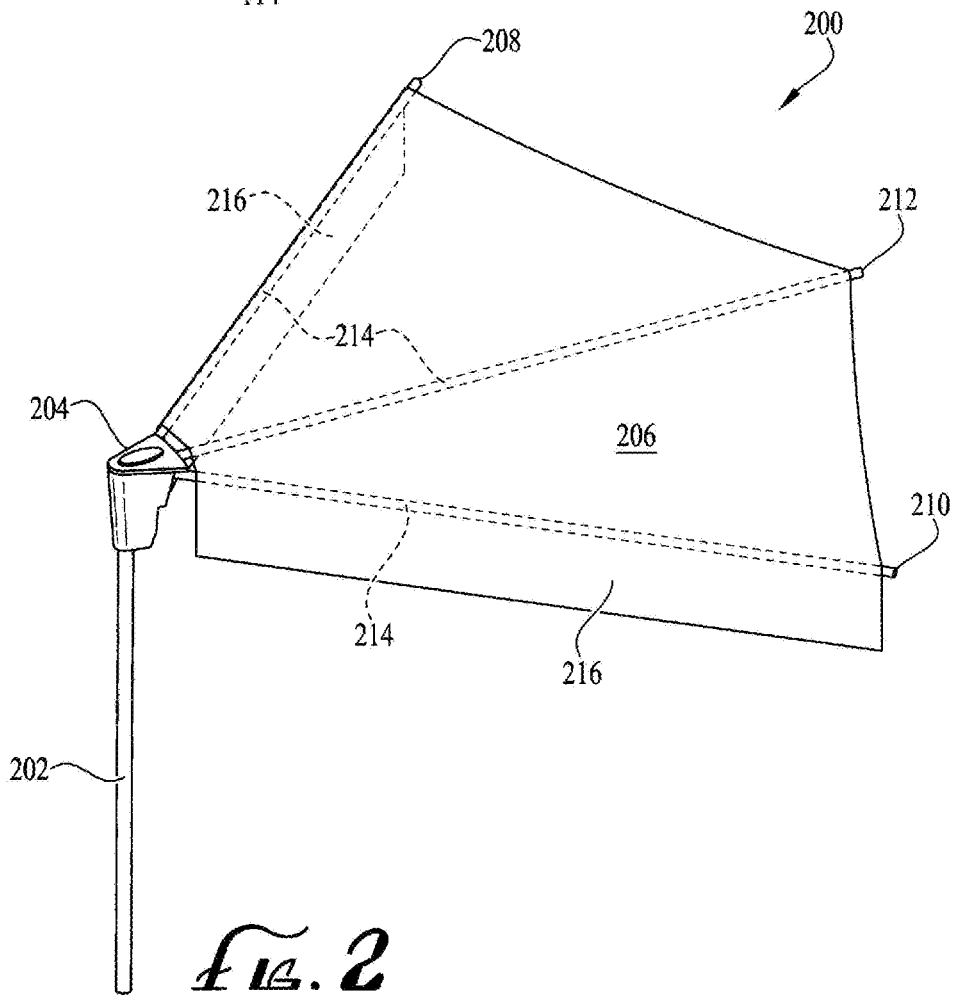
FIG. 2 illustrates a perspective view of the umbrella, with a canopy having three ribs.

Referring to FIG. 2, a second embodiment delta-shaped umbrella 200 is shown, having a handle 202, a spring-loaded second embodiment hub 204, and a second embodiment canopy 206. The canopy 206 is also delta-shaped, and the handle 202 and the hub 204 are offset to one corner of the canopy 206 for maximum coverage. Supporting the canopy 206 are a first rib 208, a second rib 210, and a third rib 212 extending away from the hub 204. The first rib 208, second rib 210, and third rib 212 are biased to an upright position, perpendicular to the handle 202, but may be folded downward to rest adjacent the handle 202 for storage when not in use. In the illustrated embodiment, the canopy 106 includes three tubes 214 through which the first rib 208, second rib 210, and third rib 212 extend, and two fringe portions 216 that hang down from under the first rib 208 and the second rib 210 to provide enhanced shading to the user.

Figure 3:
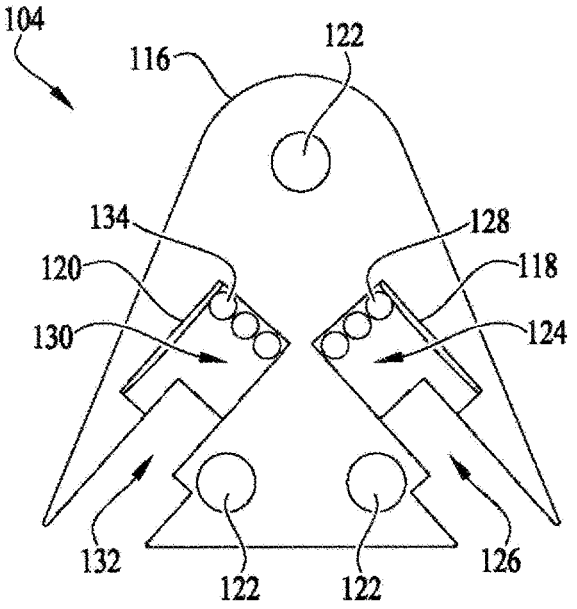
FIG. 3 illustrates a top view of the hub portion of the umbrella adapted for having a canopy with two ribs.

Referring to FIG. 3, the first embodiment hub 104 is shown from above in plan view. The hub 104 includes a handle receiving portion 116, a first spring receptacle 118, and the second spring receptacle 120. Three cap registration points 122 are provided for anchoring a first embodiment cap 144 (FIG. 8) atop the hub 104. The first spring receptacle 118 includes a first spring chamber 124 for housing the coiled portion 138 of a spring 136 (FIGS. 5-7), and a first slot 126 through which the first rib 108 travels. A series of first anchoring holes 128 are provided in the first spring chamber for accommodating a lower anchoring portion 140 of the spring 136. The second spring receptacle 120 is preferably substantially similar to the first spring receptacle 118, and includes a second spring chamber 130, second slot 132, and second anchoring holes 134.

Multiple first anchoring holes 128 and second anchoring holes 134 are provided in the first spring chamber 124 and the second spring chamber 130 to allow springs having a lower anchoring portion 140 on the left, right, or center relative to the coiled portion 138 to be easily inserted into the first spring chamber 124 and the second spring chamber 130. Additionally, by providing multiple anchoring holes 128 in the first spring chamber 124 and the second spring chamber 130, additional cooling is provided during molding, which facilitates the molding process of the hub 104.

Figure 4:
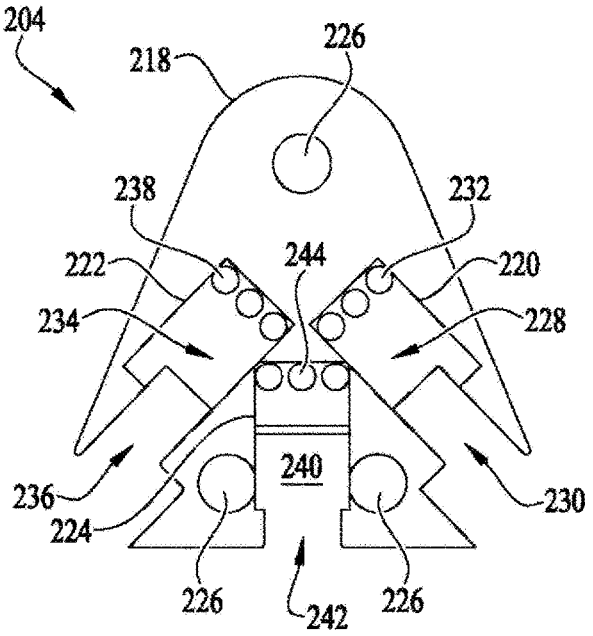
FIG. 4 illustrates a top view of the hub portion of the umbrella adapted for having a canopy with three ribs.

Referring to FIG. 4, the second embodiment hub 204 is shown from above in plan view. The hub 204 includes a handle receiving portion 218, a first spring receptacle 220, a second spring receptacle 222, and a third spring receptacle 224. Three cap registration points 226 are provided for anchoring a second embodiment cap 248 (FIG. 9) atop the hub 204. The first spring receptacle 222 includes a first spring chamber 228 for housing the coiled portion 138 of the spring 136, and a first slot 230 through which the first rib 208 travels. A series of first anchoring holes 232 are provided in the first spring chamber 228 for accommodating the lower anchoring portion 140 of the spring 136. The second spring receptacle 222 is preferably substantially similar to the first spring receptacle 220, including a second spring chamber 234, second slot 236, and second anchoring holes 238.

Still referring to FIG. 4, the second embodiment hub 204 differs from the first embodiment hub 104, in that it incorporates the third spring receptacle 224. The third spring receptacle 224 is positioned between the first spring receptacle 220 and second spring receptacle 222, and includes a third spring chamber 240 for housing the coiled portion 138 of the spring 136, and a third slot 242 through which the third rib 212 travels. The third spring receptacle 224 also includes a series of third anchoring holes 244 in the third spring chamber 240, for retaining the lower anchoring portion 140 of the spring 136, and which help to cool the hub 204 upon molding.

Figure 5:
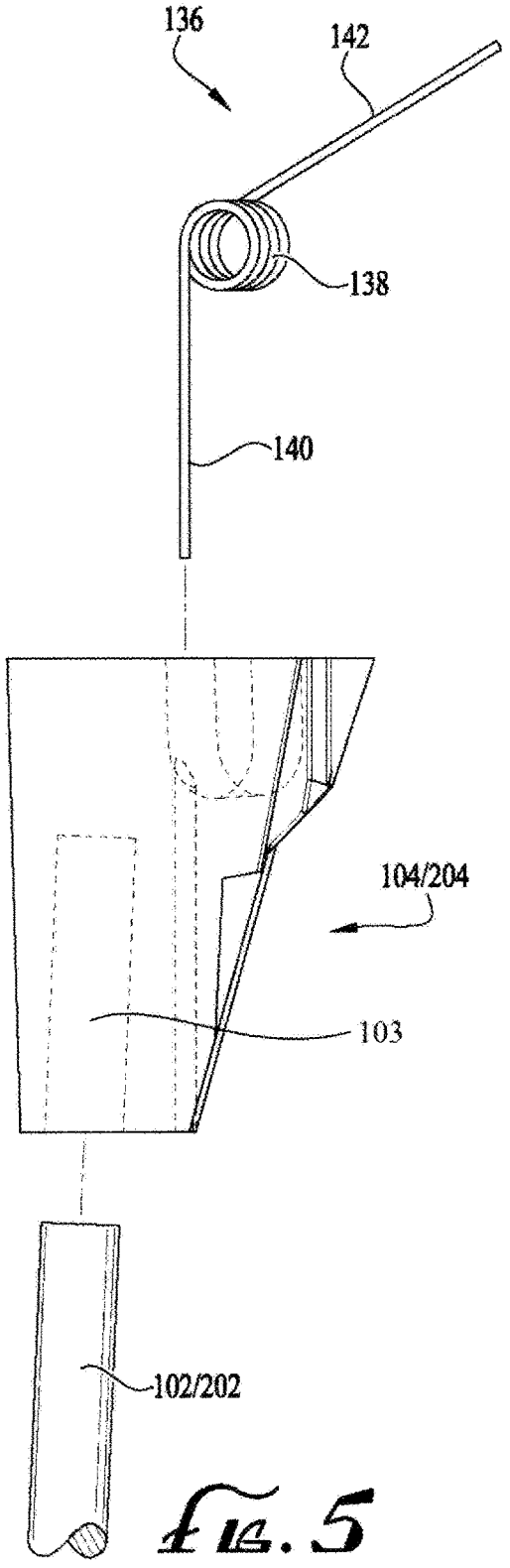
FIG. 5 illustrates an elevation exploded view of the hub portion of the umbrella, showing a handle and spring for insertion therein.

Referring to FIG. 5 an exploded elevation view of the hub 104/204 is shown including the handle 102/202 and the spring 136. In the illustrated embodiment, the handle 102/202 is simply a dowel that inserts into the hub 104/204, and may be glued in place, although other types of fixation are contemplated, such as providing a screw-type attachment, locking mechanism, or other fixation method known in the art.

The spring 136 includes a central coiled portion 138, a lower anchoring portion 140, and an upper anchoring portion 142. The coiled portion 138 is sized for insertion into the first spring chamber 124 or second spring chamber 130 of the first embodiment hub 104, or the first spring chamber 228, second spring chamber 236, or third spring chamber 242 of the second embodiment hub 204. The lower anchoring portion 140 is sized for insertion in the first anchoring holes 128 or second anchoring holes 134 of the first embodiment hub, or in the first anchoring holes 232, second anchoring holes 238, or third anchoring holes 244 of the second embodiment hub 204.

Depending on manufacture, the lower anchoring portion 140, may descend from the coiled portion 138 on the left or the right, or centrally, such that springs 136 with lower anchoring portions 140 of various orientations may be placed in one of the several anchoring holes (128, 134, 232, 238, 244) of the first embodiment hub 104 or second embodiment hub 204. The upper anchoring portion 142 is configured for insertion into the first rib 108 or second rib 110 of the first embodiment hub 104, or the first rib 208, second rib 210, or third rib 212 of the second embodiment hub 204.

Figure 6:
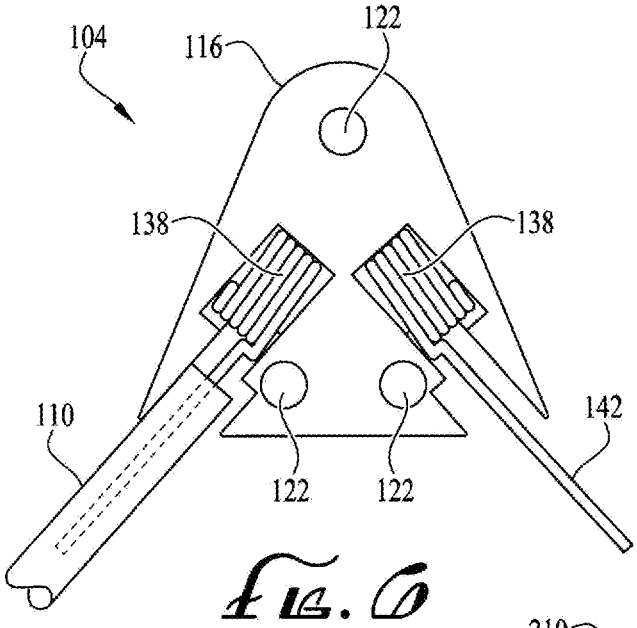
FIG. 6 illustrates a top view of the hub portion of the umbrella adapted for having a canopy with two ribs, partially assembled with springs and ribs.

Referring to FIG. 6, a top plan view of the first embodiment hub 104, partially assembled with a spring 136 and the second rib 110 installed in the second spring receptacle 120.

Figure 7:
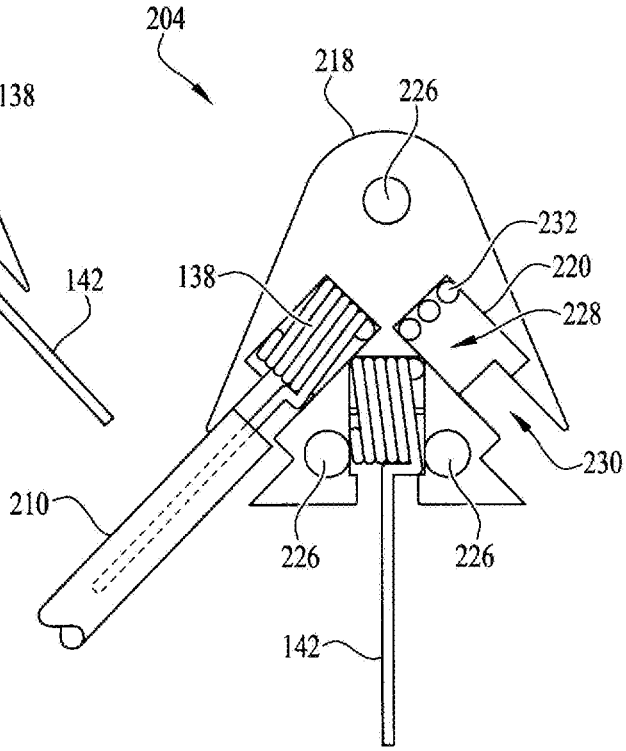
FIG. 7 illustrates a top view of the hub portion of the umbrella adapted for having a canopy with three ribs, partially assembled with springs and ribs.

Referring to FIG. 7, a top plan view of the second embodiment hub 204 is shown, partially assembled with a spring 136 installed in the third spring chamber 240 of the third spring receptacle 224, and a spring 136 installed in the second spring chamber 234 of the second spring receptacle 222, with the second rib 210 installed on the upper anchoring portion 142.

Figure 8:
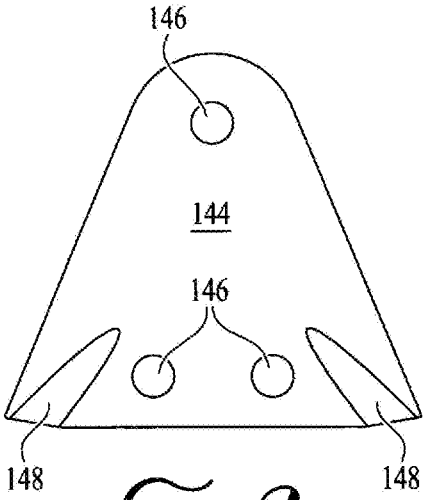
FIG. 8 illustrates a bottom view of a cap for the hub portion of the umbrella adapted for having a canopy with two ribs.
Figure 9:
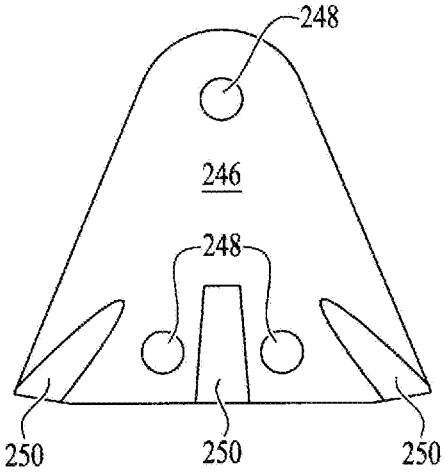
FIG. 9 illustrates a bottom view of a cap for the hub portion of the umbrella adapted for having a canopy with three ribs.

Referring to FIGS. 8 and 9, a first embodiment cap 144 and a second embodiment cap 246 are shown. Referring to FIG. 8, the first embodiment cap 144 includes secondary cap registration points 146 that align with the cap registration points 122 on the first embodiment hub 104. The cap registration points 122 and secondary cap registration points 146 may comprise complimentary recesses and protuberances on the first embodiment hub 104 and first embodiment cap 144, or may be of another type of registration point that allows the first embodiment cap 144 to be easily and quickly fitted over the first embodiment hub 104 and/or sealed thereto. The first embodiment cap 144 also preferably includes first rib recesses 148 which govern the position of the first embodiment canopy 106 in a raised position.

Referring to FIG. 9, the second embodiment cap 248 includes secondary cap registration points 250 that align with the cap registration points 226 on the second embodiment hub 204. The secondary cap registration points 250 and cap registration points 226 of the second embodiment hub 204 may be configured in any suitable manner similar to the first embodiment cap 144 and first embodiment hub 104. The second embodiment cap 246 also preferably includes several second first rib recesses 250 which govern the position of the second embodiment canopy 206 in a raised position.

Figure 10:
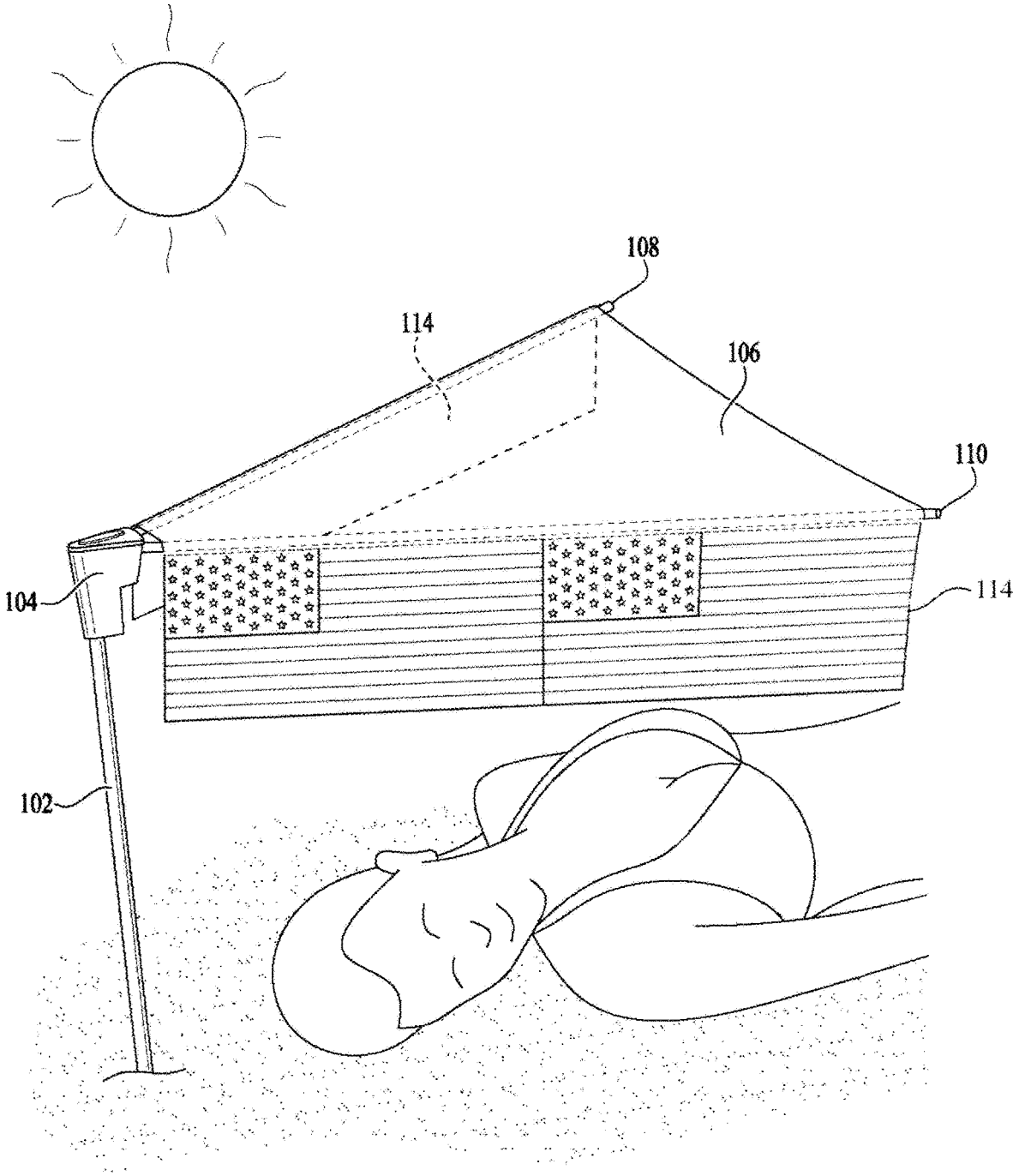
FIG. 10 illustrates a perspective view of the umbrella adapted for a canopy with two ribs in use, substantially in the same manner as the umbrella canopy adapted for three ribs.

Referring to FIG. 10, a perspective view of the first embodiment umbrella 100 is shown in use. In use, the first embodiment umbrella 100, appears substantially the same as the second embodiment umbrella 200, except that the second embodiment umbrella 200 would have a central, third rib 212, that may rise slightly higher than the first rib 208 and the second rib 210.

The structure and function of the delta-shaped umbrella having a spring-loaded hub 100/200 having been shown and described, its method of manufacture will now be discussed.

In order to manufacture the umbrella, a first embodiment hub 104, or a second embodiment hub 204 is formed, preferably by injection molding, or another method of manufacture. Thereafter a spring 136 is placed in the first spring chamber 124 and the second spring chamber 130 of the first embodiment hub 104, or the first spring chamber 228, second spring chamber 234, and third spring chamber 240 of the second embodiment hub 204. In the process, the lower anchoring portion 140 of each spring 136 is inserted into the anchoring holes (128, 134, 232, 238, 244) of their respective spring chamber (124, 130, 228, 234, 240).

With the springs 136 anchored in place by their lower anchoring portions, the first rib 108 and second rib 110 of the first embodiment umbrella 100, or the first rib 208, second rib 210, and third rib 212 of the second umbrella 200 may be slid onto the upper anchoring portions 142 of the springs 136. Thereafter, the ribs (108, 110) of the first embodiment umbrella 100 may be slid into the tubes 112 of the first embodiment canopy 106, or the ribs (208, 210, 212) of the second embodiment umbrella 200 may be slid into the tubes 214 of the second embodiment canopy 206. In some embodiments, the first embodiment canopy 106 and/or second embodiment canopy 206 may be first slid on to the ribs (108, 110, 208, 210, 212), and/or the springs 136 attached prior to insertion in the first embodiment hub 104 or second embodiment hub 204.

With the springs 136, inserted into the first embodiment hub 104 or second embodiment hub 204, and the ribs (108, 110, 208, 210, 212) and canopies (106, 206) attached, they may be folded down and secured against the handle (102, 202) prior to sale.

The foregoing descriptions of embodiments of the present invention have been presented only for purposes of illustration and description. They are not intended to be exhaustive or to limit the present invention to the forms disclosed. Accordingly, many modifications and variations will be apparent to practitioners skilled in the art. Additionally, the above disclosure is not intended to limit the present invention. The scope of the present invention is defined by the appended claims.

What is claimed is:

1. A delta-shaped umbrella apparatus for sun-shading or shielding a user from the rain, the apparatus comprising:

a hub configured for receiving a handle, the hub further configured to have a first spring receptacle, a second spring receptacle, and a third spring receptacle;

a first spring having a first coiled portion, a first lower anchoring portion and a first upper anchoring portion;

a second spring having a second coiled portion, a second lower anchoring portion, and a second upper anchoring portion;

a third spring having a third coiled portion, a third lower anchoring portion, and a third upper anchoring portion;

the first spring receptacle having a first spring chamber configured to hold the first coiled portion, a first anchoring hole configured for the first lower anchoring portion to be inserted therethrough, and a first slot;

the second spring receptacle having a second spring chamber configured to hold the second coiled portion, a second anchoring hole configured for the second lower anchoring portion to be inserted therethrough, and a second slot;

the third spring receptacle having a third spring chamber configured to hold the third coiled portion, a third anchoring hole configured for the third lower anchoring portion to be inserted therethrough, and a third slot;

a first rib anchored to the first upper anchoring portion of the first spring;

a second rib anchored to the second upper anchoring portion of the second spring;

a third rib anchored to the third upper anchoring portion of the third spring;

wherein the first slot is configured to allow the first rib to swing through a first predetermined range of motion relative to the hub, the second slot is configured to allow the second rib to swing through a second predetermined range of motion, and the third slot is configured to allow the third rib to swing through a third predetermined range of motion; and wherein the first predetermined range of motion and the second predetermined range of motion define substantially similar arcs.

2. The apparatus of claim 1 further comprising a cap covering the hub, the cap confining the first coiled portion in the first spring chamber, confining the second coiled portion in the second spring chamber, and confining the third coiled portion in the third spring chamber.

3. The apparatus of claim 1 wherein the first spring chamber comprises multiple first anchoring holes.

4. The apparatus of claim 1 wherein the second spring chamber comprises multiple second anchoring holes.

5. The apparatus of claim 1 wherein the third spring chamber comprises multiple third anchoring holes.

6. The apparatus of claim 1 wherein the first predetermined range of motion and the second predetermined range of motion each extend from a position where the first rib and the second rib are substantially parallel to the handle, to a position where the first rib and the second rib are substantially perpendicular to the handle.

7. The apparatus of claim 1 wherein the third predetermined range of motion is greater than the first range of motion and second range of motion, such that the third rib is higher than the first rib and the second rib when extended away from the handle.

8. The apparatus of claim 1 further comprising a canopy extending between the first rib and the second rib.

9. The apparatus of claim 8 wherein the canopy comprises a first tube for receiving the first rib, a second tube for receiving the second rib, and a third tube for receiving the third rib.

10. The apparatus of claim 8 wherein the canopy comprises a first fringe portion hanging from the first tube and a second fringe portion hanging from the second tube.

11. A delta-shaped umbrella apparatus for sun-shading or shielding a user from the rain, the apparatus comprising:

a hub configured for receiving a handle, the hub further configured to have a first spring receptacle and a second spring receptacle;

a first spring having a first coiled portion, a first lower anchoring portion, and a first upper anchoring portion;

a second spring having a second coiled portion, a second lower anchoring portion, and a second upper anchoring portion;

the first spring receptacle having a first spring chamber configured to hold the first coiled portion, a first anchoring hole configured for the first lower anchoring portion to be inserted therethrough, and a first slot;

the second spring receptacle having a second spring chamber configured to hold the second coiled portion, a second anchoring hole configured for the second lower anchoring portion to be inserted therethrough, and a second slot;

a first rib anchored to the first upper anchoring portion of the first spring;

a second rib anchored to the second upper anchoring portion of the second spring;

wherein the first slot is configured to allow the first rib to swing through a first predetermined range of motion relative to the hub, and the second slot is configured to allow the second rib to swing through a second predetermined range of motion; and wherein the first predetermined range of motion and the second predetermined range of motion define substantially similar arcs.

12. The apparatus of claim 11 further comprising a cap covering the hub, the cap confining the first coiled portion in the first spring chamber, and confining the second coiled portion in the second spring chamber.

13. The apparatus of claim 11 wherein the first spring chamber comprises multiple first anchoring holes.

14. The apparatus of claim 11 wherein the second spring chamber comprises multiple second anchoring holes.

15. The apparatus of claim 11 wherein the first predetermined range of motion and the second predetermined range of motion each extend from a position where the first rib and the second rib are substantially parallel to the handle, to a position where the first rib and the second rib are substantially perpendicular to the handle.

16. The apparatus of claim 11 further comprising a canopy extending between the first rib and the second rib.

17. The apparatus of claim 16 wherein the canopy comprises a first tube for receiving the first rib, and a second tube for receiving the second rib.

18. The apparatus of claim 16 wherein the canopy comprises a first fringe portion hanging from the first tube and a second fringe portion hanging from the second tube.

19. A delta-shaped umbrella apparatus for sun-shading or shielding a user from the rain, the apparatus comprising:

a hub configured for receiving a handle, the hub further configured to have a plurality of spring receptacles;

a plurality of springs, each spring having a coiled portion, a lower anchoring portion, and an upper anchoring portion;

each spring receptacle having a spring chamber configured to hold the coiled portion, at least one anchoring hole configured for the lower anchoring portion to be inserted therethrough, and a slot;

a plurality of ribs anchored to the upper anchoring portion of the plurality of springs;

wherein the slots are configured to allow the at least one rib to swing through a predetermined range of motion relative to the hub; and wherein the predetermined range of motion defines an arc extending from a position substantially parallel to the handle to a position substantially perpendicular to the handle.

20. The apparatus of claim 19 further comprising a canopy supported by the plurality of ribs.

* * * * *